US008770595B2

(12) United States Patent
Cruikshank et al.

(10) Patent No.: US 8,770,595 B2
(45) Date of Patent: Jul. 8, 2014

(54) ICE HOCKEY RUNNER-BLADE ASSEMBLY

(75) Inventors: David W. Cruikshank, Delafield, WI (US); Edward L. Altshuler, Erie, CO (US)

(73) Assignee: Easton Sports, Inc., Van Nuys, CA (US)

( * ) Notice: Subject to any disclaimer, the term of this patent is extended or adjusted under 35 U.S.C. 154(b) by 0 days.

(21) Appl. No.: 13/566,896

(22) Filed: Aug. 3, 2012

(65) Prior Publication Data

US 2013/0038031 A1 Feb. 14, 2013

Related U.S. Application Data

(60) Provisional application No. 61/522,058, filed on Aug. 10, 2011.

(51) Int. Cl.
*A63C 1/24* (2006.01)

(52) U.S. Cl.
USPC ..... 280/11.14; 280/11.17

(58) Field of Classification Search
USPC ..... 280/11.12, 11.14, 11.15, 11.16, 11.17, 280/11.225
See application file for complete search history.

(56) References Cited

U.S. PATENT DOCUMENTS 1,773,017 A * 8/1930 Thompson ..... 280/11.17
3,243,191 A * 3/1966 Weisman ..... 280/11.12
3,437,344 A * 4/1969 Shevelson ..... 280/11.209
5,137,290 A * 8/1992 Patterson et al. ..... 280/11.12
5,505,467 A * 4/1996 Hill et al. ..... 280/11.16
5,904,360 A * 5/1999 Oliemans et al. ..... 280/11.28
2003/0234499 A1* 12/2003 Rudolph ..... 280/11.17
2009/0045616 A1* 2/2009 Eldridge ..... 280/844

FOREIGN PATENT DOCUMENTS

DE 545394 C 3/1932

OTHER PUBLICATIONS

United States Patent and Trademark Office, International Search Report and Written Opinion for PCT/US12/49618, Oct. 26, 2012.

* cited by examiner

*Primary Examiner* — John Walters
(74) *Attorney, Agent, or Firm* — Perkins Coie LLP

(57) ABSTRACT

A customizable hockey skate includes a removable runner-blade assembly such that a runner-blade assembly having a first stiffness may be readily replaced with a runner-blade assembly having a second stiffness. The runner-blade assembly may be removably attached to first and second cups that are optionally removably attached to the sole of a skate boot. The first and second cups optionally are removably attachable at multiple lateral locations on the sole. Mounting plates to which the first and second cups are mounted may be included to provide damping interfaces between the first and second cups and the boot sole. The first and second cups may be separately removable from the sole such that the first cup may be replaced with a third cup (for example, a cup having a different stiffness than the first cup) without removal of the second cup.

18 Claims, 14 Drawing Sheets

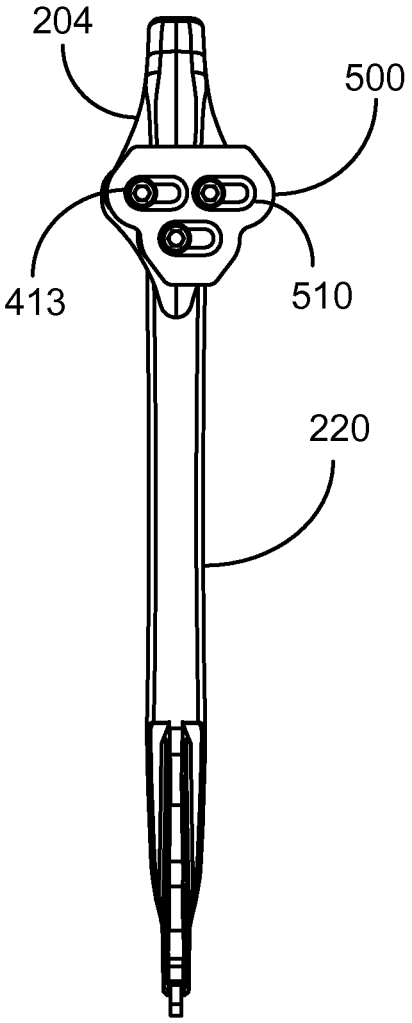
FIG. 5B1
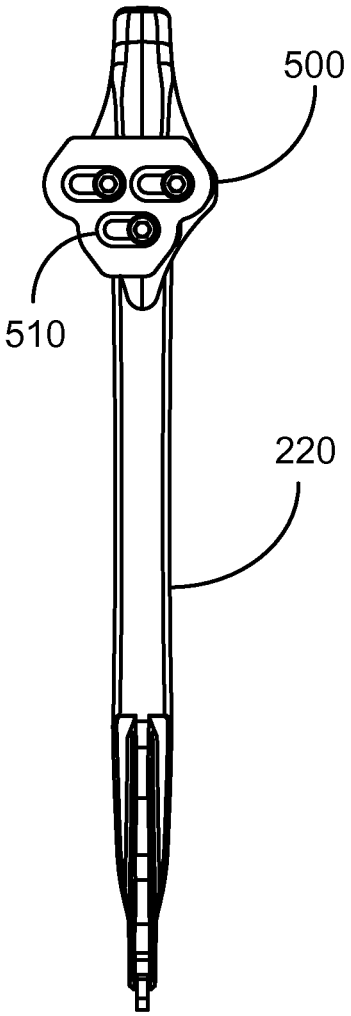
FIG. 5B2

ICE HOCKEY RUNNER-BLADE ASSEMBLY

CROSS-REFERENCE TO RELATED APPLICATIONS

This application claims the benefit of U.S. Provisional Patent Application No. 61/522,058, filed Aug. 10, 2011, which is incorporated herein by reference.

BACKGROUND

The present embodiments are directed to an ice hockey skate system that is useful in providing optional blade stiffness and ease of swapping out ice hockey skate blades.

For nearly 150 years, hockey has been an important winter pastime for outdoor enthusiasts. In that time, hockey has evolved in rules and equipment. For example, in 1879, teams had nine players on each side, yet today teams have only six players. Also, old fashioned hockey skates were once steel blades tied to the bottom of stiff pair of shoes, but today their construction can include over-molded stainless steel blades attached to high technology skate boots.

Today the sport of ice hockey has spread to street hockey, which does not require any skate whatsoever to rollerblading and roller skating. However, the hockey skate is distinguishable over other forms of roller related skates, such as roller skates or roller blades because of the high rigidity required by the ice hockey skate. Accordingly, the only thing similar between a roller skate or roller blade and a hockey skate is the boot. All other aspects have diverged (though they may look similar) because of the very different requirements between ice hockey skates and roller blades, roller skates, etc.

FIG. 1 is a prior art illustration depicting the present state of the art hockey skate 100. As depicted, today's hockey skate 100 provides a standard leather or plastic boot 104 with a tendon guard 102 and a high stiffness arrangement comprising a skate blade 108 embedded in a one-piece blade holder 106 that is riveted or screwed onto the boot sole 112.

It is to innovative improvements related to ice hockey skates systems that the claimed invention is generally directed.

SUMMARY

The present embodiments generally relate to an ice hockey skate system that is useful in providing optional blade stiffness and ease of swapping out ice hockey skate blades. Some embodiments of the present invention contemplate a hockey skate apparatus comprising: a first runner-blade assembly that possesses: a steel ice-hockey skate blade that extends in length between a front end and a back end and has an ice surface and a top surface; a runner that is integrated with the skate blade, the runner essentially covers the top surface and extends part way towards the ice surface; a front cup removably attached to the first runner-blade assembly towards the front end; a back cup removably attached to the first runner-blade assembly towards the back end, the back cup and the front cup are adapted to be independent from one another, the front cup and the back cup are of a different material than the runner; the front cup and the back cup are removably attached to an ice-skate boot sole such that when fully assembled, the cups and the first runner-blade assembly essentially form a rigid structure connected to the ice-skate boot sole; the first runner-blade assembly adapted to be replaced with a second runner-blade assembly that possesses a different stiffness than the first runner-blade assembly.

Other embodiments contemplate the hockey skate wherein the front cup and the back cup have different vibration damping properties than the runner, wherein the front cup is removably attached to the first runner-blade assembly via a front bolt and the back cup is removably attached to the first runner-blade assembly via a back bolt, wherein the first runner-blade assembly is adapted to be replaced with the second runner-blade assembly by removing the front cup and the back cup from the ice-skate boot sole, wherein at least one of the cups is adapted to be removably attached to the ice-skate boot sole in various lateral positions, wherein the runner is composed of a polymer based material, wherein the cups are composed of magnesium, wherein further comprising either a front mounting plate between the front cup and the ice-skate boot sole or a back mounting plate between the back cup and the ice-skate boot sole, the runner essentially covers the top surface of the skate blade means the runner covers at least 90% of the top surface, the first runner-blade assembly is attached to the front cup by way of a bolt that is accommodated by a hole that penetrates both the skate blade and the runner.

Yet other embodiments envision the hockey skate apparatus wherein the runner possesses a slot that accommodates the skate blade, and further, the skate blade is received by a plurality of different runners wherein each of the runners provides different stiffness.

Other embodiments contemplate the hockey skate apparatus further comprising both a front mounting plate between the front cup and the ice-skate boot sole and a back mounting plate between the back cup and the ice-skate boot sole, wherein the mounting plate is metal, wherein the mounting plates are adapted to create a vibration damping interface, wherein the mounting plates further include at least one layer of dissimilar material adapted to create a vibration damping interface, wherein the at least one layer of dissimilar material is from the group consisting of: a metal plate, a polymer, a compliant metal (lead), compliant glue.

Other embodiments contemplate a hockey skate apparatus comprising: a hockey boot possessing a boot sole that defines a toe end and a heel end; attached to the boot sole near the toe end is a first cup and attached to the boot sole near the heel end is a second cup, wherein the first cup is capable of being swapped out with a like first cup from the boot sole while the second cup remains attached; a first runner-blade assembly attached to the first and the second cups, the runner-blade assembly possessing a steel ice-hockey skate blade that extends in length between a front end and a back end and has an ice surface and a top surface; the runner-blade assembly further possessing a runner that is integrated with the skate blade, the runner covers a significant portion of the length of the top surface and extends part way towards the ice surface on both sides of the skate blade; the cups and the first runner-blade assembly when fully attached to the boot sole are essentially positionally fixed.

Yet other embodiments envision the hockey skate apparatus wherein the first cup is a different material than the second cup, or wherein the cups are attached to the boot sole via at least one intermediary structure, wherein the at least one intermediary structure is an interface plate or wherein the at least one intermediary structure is made of a different material than the cups.

Yet other embodiments contemplate a method comprising: providing a first runner-blade assembly that is fixedly connected to a first front cup and a first back cup wherein the first cups are attached to a hockey skate sole, the first cups are positionally static relative the first runner-blade assembly and the hockey skate sole; detaching the first cups from the hockey skate sole without detaching the first runner-blade assembly; attaching a second front cup and a second rear cup, that are fixedly connected to a second runner-blade assembly, to the hockey skate sole wherein the second runner-blade assembly has a different stiffness than the first runner-blade assembly.

BRIEF DESCRIPTION OF THE DRAWINGS

FIGS. 5A-5C are illustrations of a mounting plate and the mounting plate's relationship with the runner-blade assembly constructed in accordance with certain embodiments of the present invention.

DETAILED DESCRIPTION

Before proceeding with the detailed description, it is to be appreciated that the present teaching is by way of example only, not by limitation. The concepts herein are not limited to use or application with a specific ice hockey skate system or method. Thus, although the instrumentalities described herein are for the convenience of explanation shown and described with respect to exemplary embodiments, it will be understood and appreciated that the principles herein may be applied equally in various types of ice hockey skates.

It should further be appreciated that the forgoing description is strictly intended for only ice hockey skates because the demands on the structures that comprise the inventive embodiments provide the essential rigidity absent in non-ice hockey skates, such as roller-blades, for example. Non-ice hockey skates, such as roller-blades require the kind of vibration related structures to compensate for rough asphalt and bumpy surfaces, which do not exist on a sheet of ice.

Figure 2A:
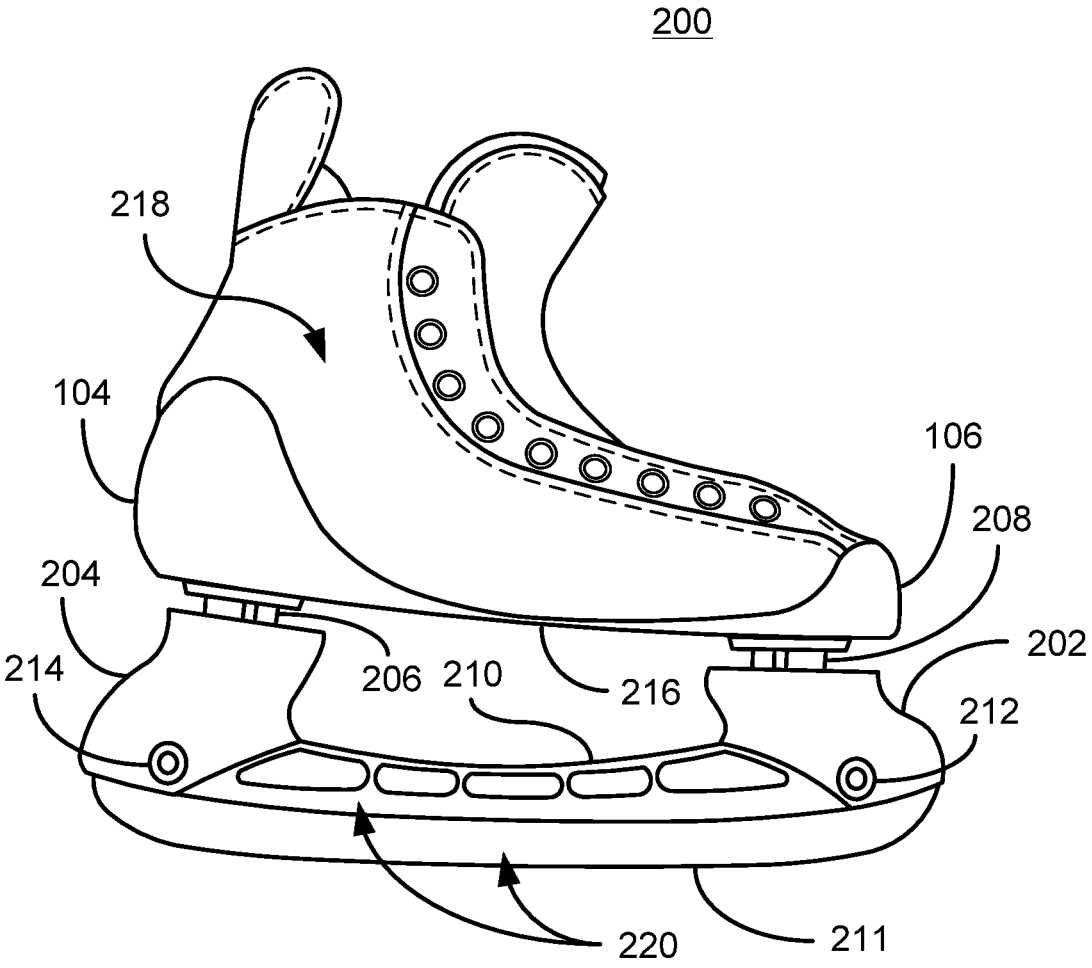
FIGS. 2A and 2B are illustrations of an ice hockey skate constructed in accordance with certain embodiments of the present invention.

Referring to the drawings in general, and more specifically to FIG. 2A, shown therein is an illustration of a ice hockey skate arrangement 200 constructed in accordance with various embodiments of the present invention. In what follows, similar or identical structures may be identified using identical callouts.

More specifically, FIG. 2A illustratively shows the hockey skate arrangement 200 possessing a hockey skate boot 218, which is adapted to accommodate a hockey player's foot (not shown). The hockey skate boot 218 has a toe end (front end) 106 and a heel end (back end) 104. Fixedly attached to the ice hockey skate boot sole 216 at the toe end 106 is a front mounting plate 208. Fixedly attached to the ice hockey skate boot sole 216 at the heel end 104 is a rear mounting plate 206. The front mounting plate 208 removably connects a front cup 202 to the toe end 106 of the boot sole 216 and the back mounting plate 206 removably connects a back cup 204 of the heel end 104 of the boot sole 216. The term removably attached is used herein to indicate that an object is essentially rigidly attached to another object but removable such as by bolts, screws, etc. Objects which are glued or welded together are considered not removably attached because there is no intention to separate the objects. The front cup 202 and the back cup 204 are removably connected to a runner-blade assembly 220 via a front bolt 212 and a rear bolt 214 respectively. The term cup is used herein to mean any structure or mechanism suitable for directly or indirectly attaching the runner-blade assembly 220 to the skate boot. The runner-blade assembly 220 is comprised of an ice-hockey blade 211, preferably made from stainless steel, that is integrated with a runner 210, preferably made from a polymeric material, such as nylon to withstand impacts of a hockey puck, hockey stick, or other hockey skate, for example.

Figure 2B:
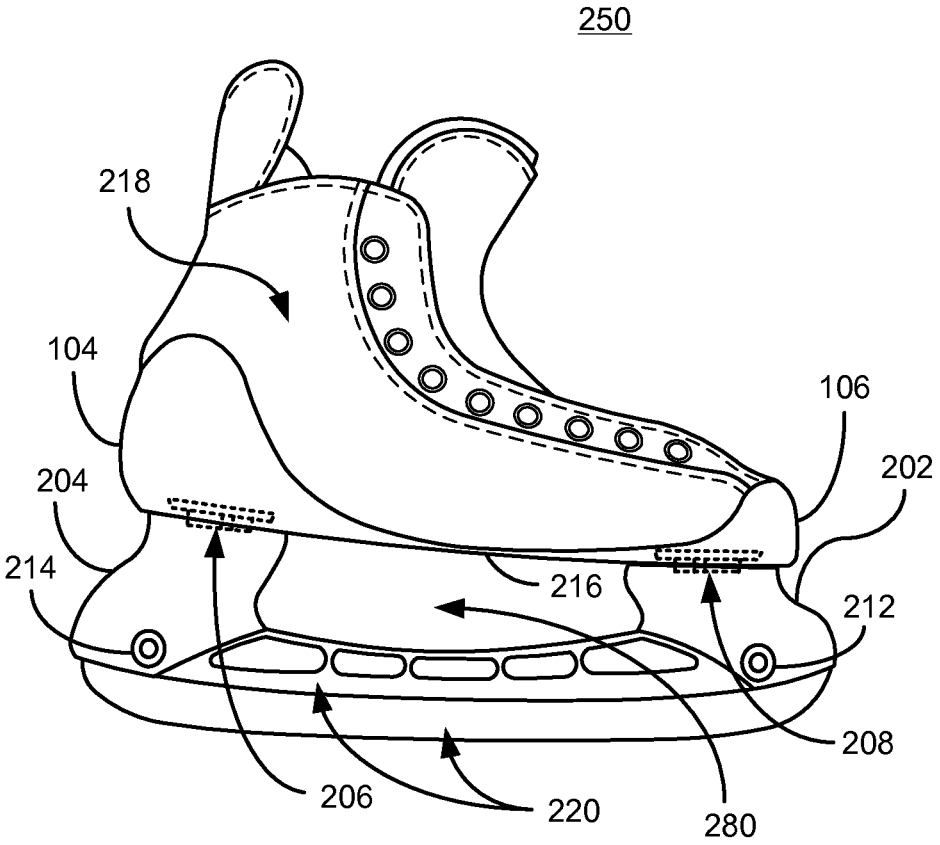

FIG. 2B illustrates a preferred embodiment consistent with embodiments of the present invention wherein the front mounting plate 208 is recessed in the front cup 202 and the rear mounting plate 206 is recessed in the back cup 204 such that the cups 202 and 204 are essentially flush with the bottom/externally exposed part of the boot sole 216. As shown by the illustrative embodiment, the constructed components essentially comprise the runner-blade assembly 220, the cups 202 and 204, the mounting plates 208 and 206 and the boot sole 216 to form, more or less, a rigid structure. That is, the constructed components when attached are immobile and static with the exception of the natural deflection properties associated with the structures that are dictated by modulus of elasticity and moment(s) of inertia. Hence, to a layman, the constructed components essentially feel like a solid rigid structure when attempted to be manipulated by a pair of hands. Certain embodiments contemplate the opening 280 can optionally be small enough to prevent a hockey puck from going through the opening 280. Optional embodiments contemplate a shield (not shown) that can block a substantial portion, or all of, the opening 280.

With reference to FIGS. 3A-3D, shown therein is an embodiment of the runner-blade assembly 220 consistent with embodiments of the present invention. As illustratively shown in FIG. 3A, in conjunction with FIG. 3B and FIG. 3C, the runner-blade assembly 220 is generally comprised of runner 210 that is integrated with an ice skate blade 211. The ice skate blade 211 extends in length between a front end 308 and a back end 306, whereby the front end 308 corresponds to approximately where the toe end 106 of the hockey skate boot 218 resides and the back end 306 corresponds to approximately where the heel end 104 of the hockey skate boot 218 resides (see FIGS. 2A and 2B). Certain embodiments of the present invention contemplate the front end 308 of the runner-blade assembly 220 extending beyond the toe end 106 of the hockey skate boot 218 (shown in FIG. 2A), and, optionally, the back end 306 of the runner-blade assembly 220 extending beyond the heel end 104 of the hockey skate boot 218 (shown in FIG. 2A). With further reference to the ice skate blade 211 embodiment, shown in FIG. 3B, the ice skate blade 211 is defined by a top surface 312 and an ice surface 310, whereby the ice surface 310 is adapted to be in contact with a sheet of ice (not shown). The runner 210 is integrated with the ice skate blade 211 such that the runner 210 essentially covers the top surface 312 of the ice skate blade 211. As shown in the present illustrative embodiment, the front end 318 of the ice skate blade 211 extends beyond the runner 210, however the back end 320 of the ice skate blade 211 does not extend beyond the runner 210, hence, the runner 210 essentially covers the top surface 312 of the ice skate blade 211. In this embodiment, essentially covers is contemplated to mean that at least 90% of the top surface 312 of the ice skate blade 211 is covered by the runner 210. In optional embodiments, the back end 220 of the ice skate blade 211 extends beyond the runner 210. As further shown, the ice skate blade 211 includes a front protrusion 316 that accommodates a front hole 304 and a rear protrusion 314 that accommodates a rear hole 304. The front hole 304 and the rear hole 302 provide a suitable location for the front bolt 212 and the rear bolt 214 to respectively connect the runner-blade assembly 220 to the front cup 202 and the back cup 204. Optional embodiments contemplate other means for removably connecting the runner-blade assembly 220 to the front cup 202 and the back cup 204, such as pins, for example.

Figure 3A:
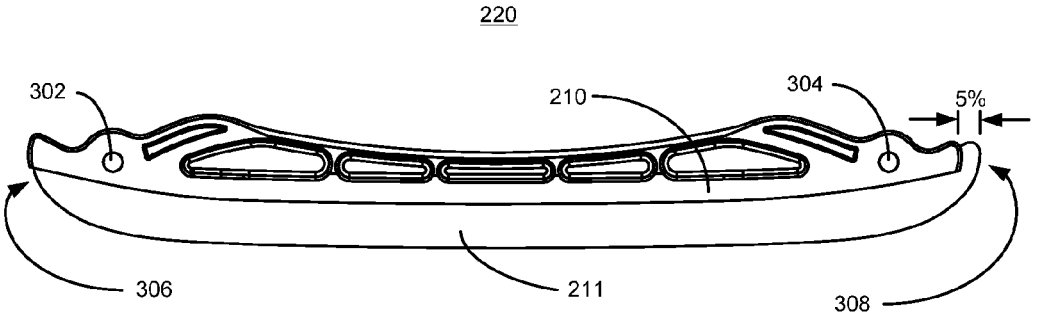
FIGS. 3A-3D are illustrations of an ice hockey blade and runner and runner-blade assembly constructed in accordance with certain embodiments of the present invention.
Figure 3B:
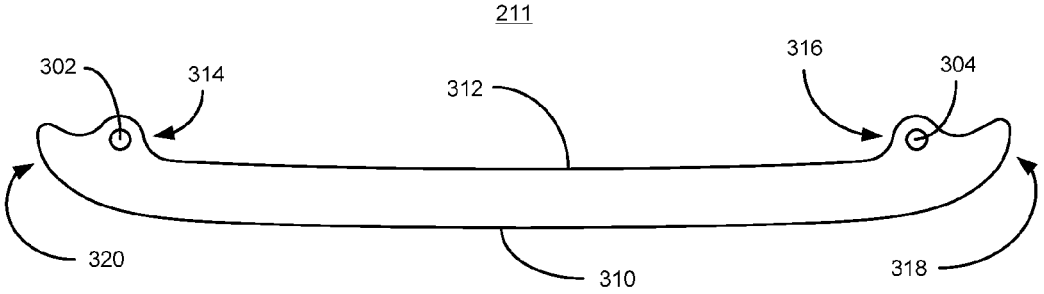
Figure 3C:
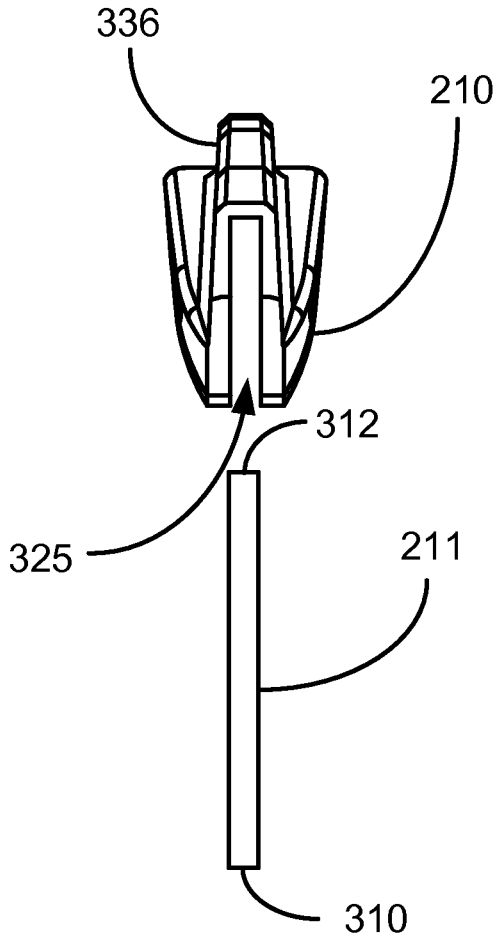
Figure 3D:
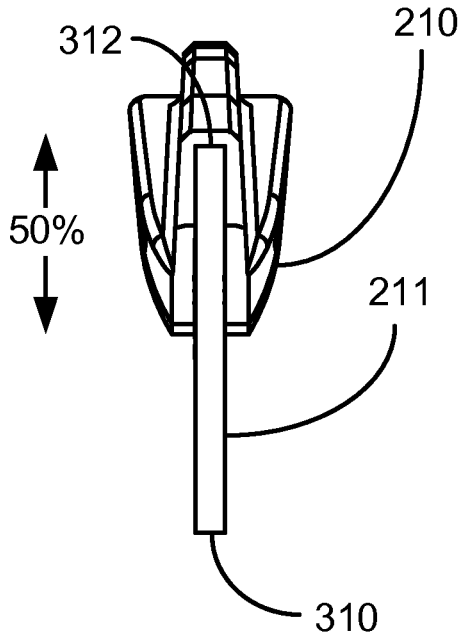

FIG. 3C provides an axial views of the front 308 of the runner-blade assembly 220 integrated with the runner 210 and the ice skate blade 211 and FIG. 3D provides an axial view of the front 308 of the runner-blade assembly 220 not integrated with the runner 210 and the ice skate blade 211, consistent with certain embodiments of the present invention. As shown in FIG. 3C, the runner 210 is adapted to accommodates the ice skate blade 211 via a slot 325. The top of the runner 210 is also illustratively shown possessing a runner-blade tongue 336 that engages a cup 202, discussed in more detail in conjunction with FIGS. 5A and 5B. FIG. 3D illustratively shows the runner 210 extending over the top surface 312 of the ice skate blade 211 about 50% part way towards the ice surface 310. In a preferred embodiment, the runner 210 extends between 25%-75% from the top surface 312 of the ice skate blade 211 towards the ice surface 310 of the ice skate blade 211. Other embodiments contemplate the runner 210 extending from the top surface 312 of the ice skate blade 211 towards the ice surface 310 of the ice skate blade 211 in different percentages. Certain embodiments contemplate the runner 210 being made from a polymeric material such as nylon 6/6 to withstand being struck by a hockey puck. Yet other embodiments contemplate the runner 210 being constructed from a carbon fiber, such as a carbon mesh in a resin that is directionally positioned to provide various engineered stiffness.

In an optional embodiment, the ice skate blade 211 and the runner 210 are irremovably connected. One embodiment contemplates the runner 210 formed over the ice skate blade 211 and a polymeric runner material molded over the ice skate blade 211 and cured with contiguous polymeric material in the holes 302 and 304, thus locking the ice skate blade 211 to the runner 210. Other embodiments contemplate a different means for irremovably connecting the runner 210 and the ice skate blade such as rivets, pins that are expanded in the holes 302 and 304, over-molded bolts and pins, etc.

Figure 4A:
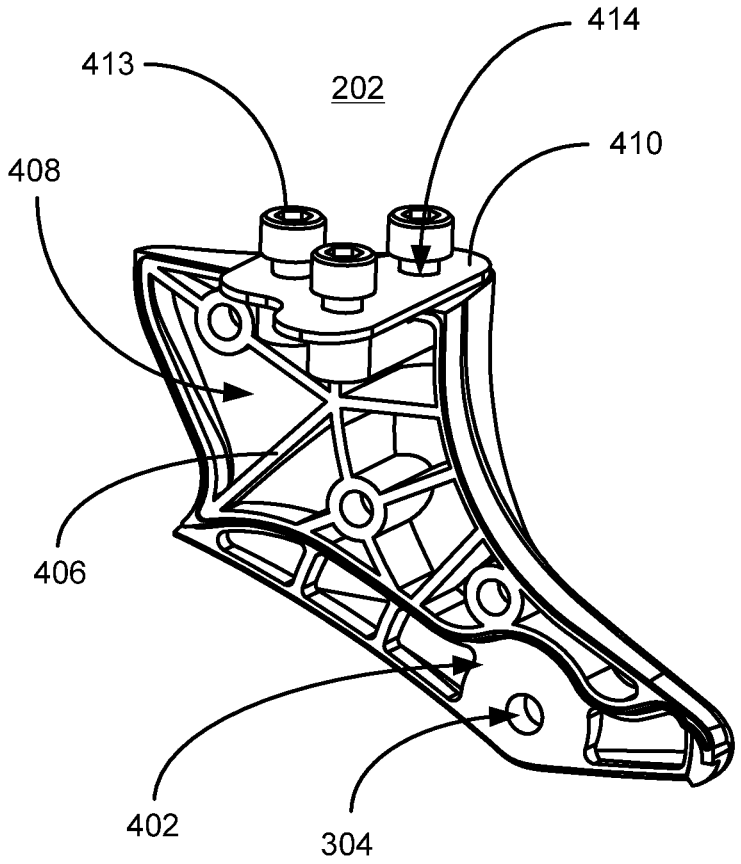
FIGS. 4A-4F are illustrations of ice hockey cups including their construction with a ice hockey blade and runner-blade assembly constructed in accordance with certain embodiments of the present invention.
Figure 4B:
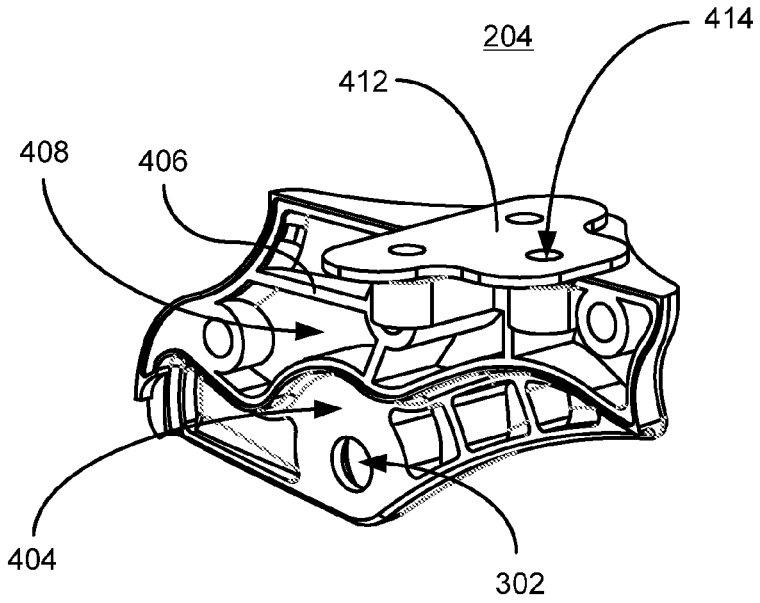

FIGS. 4A-4E illustratively show an embodiment of cups 202 and 204 in more detail. With reference to FIGS. 4A and 4B, shown therein are perspective views of one half of the front cup 202 and one half of the back cup 204, respectively. Both the front cup 202 and the back cup 204 show a hollowed out portion 408 and stiffening webs 406. The hollowed out portion 408 provides weight reduction while the stiffening webs 406 increase the stiffness of the cups 202 and 204. The front cup 202 illustratively shows a front runner-blade assembly cup space 402 that accommodates the front end 308 of the runner-blade assembly 220. The front cup 202 further provides a front hole 304 adapted to align with the front hole 304 in the runner-blade assembly 220 to accommodate the front bolt 212. Likewise, the back cup 204 illustratively shows a back runner-blade assembly cup space 404 that accommodates the back end 306 of the runner-blade assembly 220. The back cup 204 further provides a back hole 302 adapted to align with the back hole 302 in the runner-blade assembly 220 to accommodate the back bolt 214. The front runner-blade assembly cup space 402 and rear runner-blade assembly cup space 404 are recessed to accommodate the width of the runner-blade assembly 220. The front and back cups 202 and 204 also provide top surfaces 410 and 412 and holes 414, respectively, that can accommodate the mating surfaces of the front mounting plate 208 and the rear mounting plate 206, which are removably attached via cup-plate bolts 413.

Figure 4C:
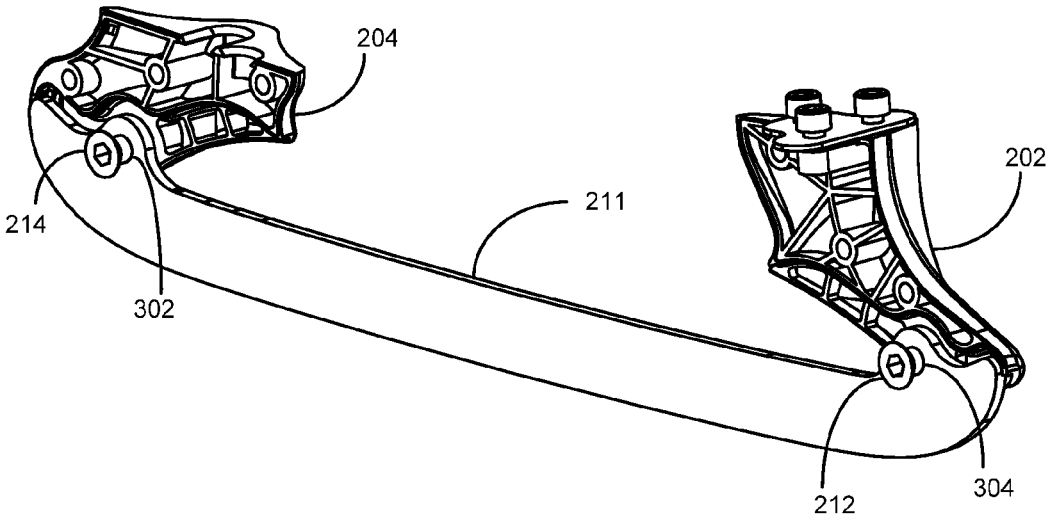

FIG. 4C illustratively shows an embodiment of a cut-away assembly of one half of the front cup 202 and one half of the back cup 204 with the ice skate blade 211 in a removably attached position. The ice skate blade 211 is shown without the runner 210 to illustrate the position of the ice skate blade 211 relative to the cups 202 and 204. The front bolt 212 and the back bolt 214 are disposed in the respective holes 304 and 302 to help illustrate the placement of the ice skate blade 211.

Figure 4D:
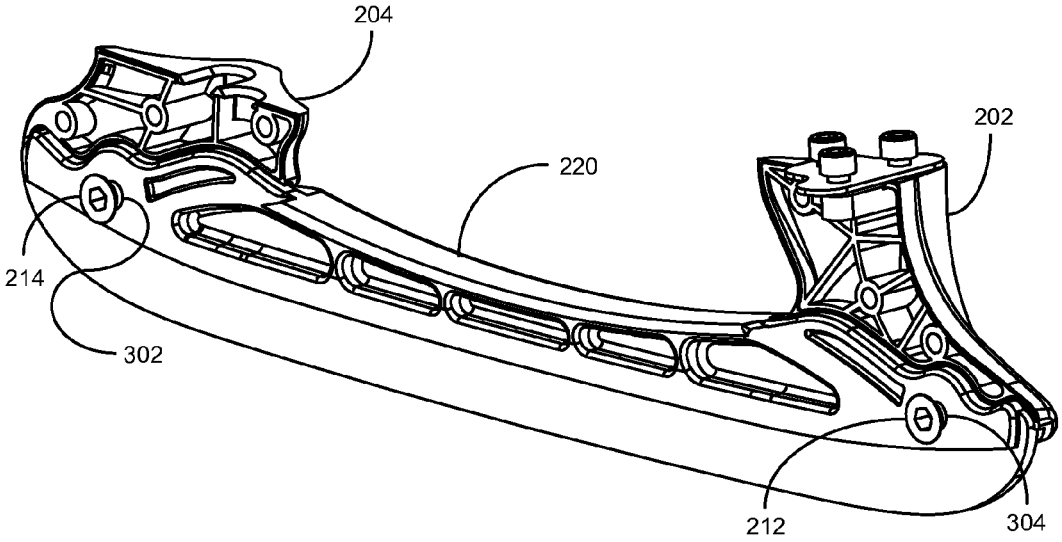

FIG. 4D illustratively shows an embodiment of a cut-away assembly of one half of the front cup 202 and one half of the back cup 204 with the runner-blade assembly 220 in an attached position. The runner-blade assembly 220 is illustratively shown in a mounted position with the front bolt 212 and the back bolt 214 in the respective holes 304 and 302.

Figure 4E:
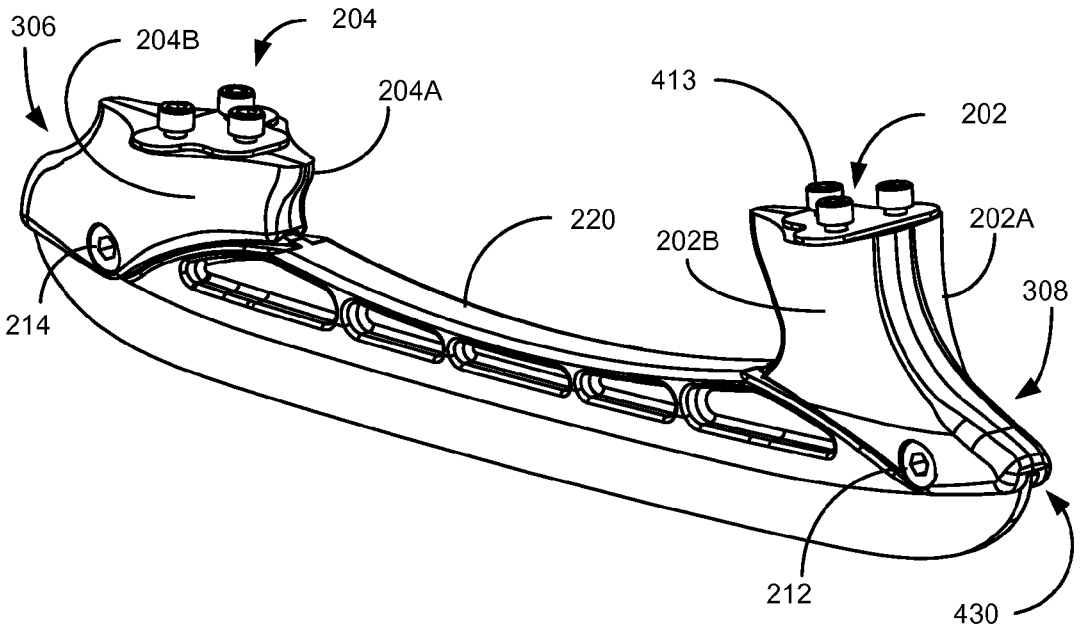

FIG. 4E illustratively shows an embodiment of a full assembly of the front cup 202 and the back cup 204 with the runner-blade assembly 220 removably connected thereto. The runner-blade assembly 220 is in a mounted position with the front bolt 212 and the back bolt 214 disposed in the respective holes 304 and 302. Hence, the back cup 204 is removably attached to the runner-blade assembly 220 towards the back end 306 and the front cup 202 is removably attached to the runner-blade assembly 220 towards the front end 308. Because the front cup 202 is separate and independent from the back cup 204, the front cup 202 can be replaced (swapped out) with a different front cup while the back cup 204 remains attached to the runner-blade assembly 220, and vice-versa. The runner-blade assembly 220 fits, via a runner-blade tongue 336 (shown in FIG. 3), into an accommodating runner-blade assembly slot 430 in the cups 202 and 204. In the present embodiment, the front cup halves 202A and 202B and the back cup halves 204A and 204B are fixedly assembled together with epoxy, however other means for fixedly attaching the halves of the cups together contemplate bolts, welds, and other means known to those skilled in the art. In an optional embodiment, the front cup 202 and back cup 204 do not have halves but are rather formed as a single cup 202 and 204. In another optional embodiment, the front cup halves 202A and 202B and the back cup halves 204A and 204B are removably assembled together with bolts, however other means for attaching the cup halves such pins, latches or quick releases are contemplated. Certain embodiments contemplate the cups 202 and 204 being made from metal, such as a titanium alloy or an aluminum alloy to withstand the shock impact of a hockey puck or stick, for example. Other embodiments contemplate the cups 202 and 204 being made out of composite carbon such as a woven carbon mesh in a resin. Yet other embodiments envision stiff composite polymer cups 202 and 204.

Figure 4F:
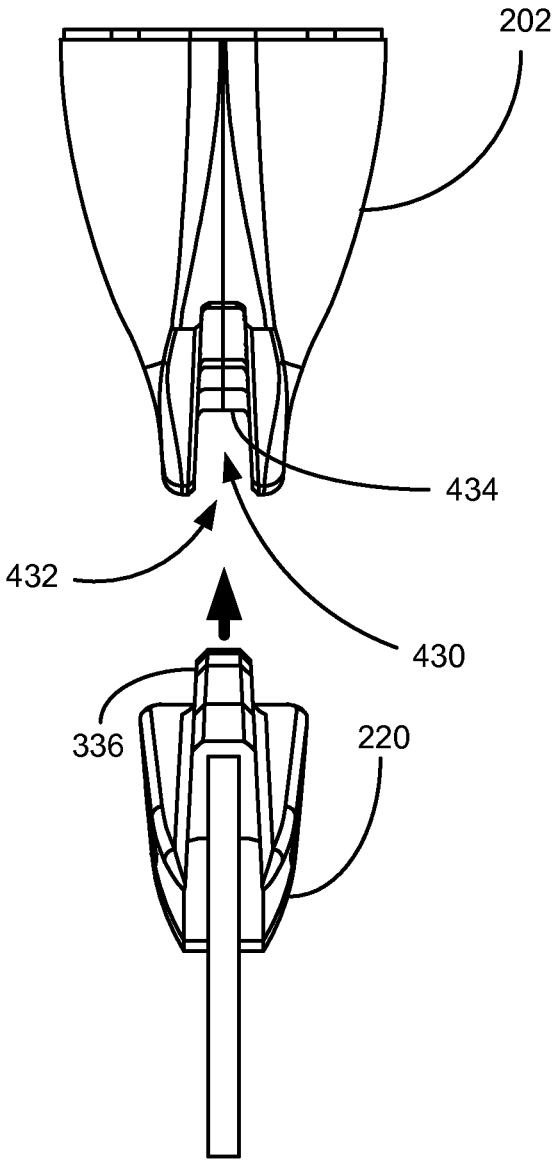

FIG. 4F illustratively shows a front view of the runner-blade assembly 220 removably attached to the front cup 202. The runner-blade tongue 336 fits into the accommodating runner-blade assembly slot 430, as shown. Certain embodiments contemplate the runner-blade assembly slot 430 comprising an angle that tapers from the opening of the slot 432 to the back of the slot 434 in order to improve the seating of the runner-blade assembly 220, or more specifically the runner-blade tongue 336, in the slot to a "snug fit". Certain embodiments further contemplate the runner-blade tongue 336 possessing a similar angle to the angle of the tapered runner-blade assembly slot 430 in order to optimally mate. In a preferred embodiment, the tapered runner-blade assembly slot 430 is between 1 degree and 8 degrees whereby the opening of the slot 432 is wider than the back of the slot 434. Other embodiments contemplate a taper as much as 25 degrees or more. Optional embodiments contemplate a compliant surface, such as a rubber coating, on the surface of slot 432 and/or the runner-blade tongue 336 to improve friction between the slot 432 and the runner-blade tongue 336 when assembled together with the bolts 212 and 214.

Figure 5A:
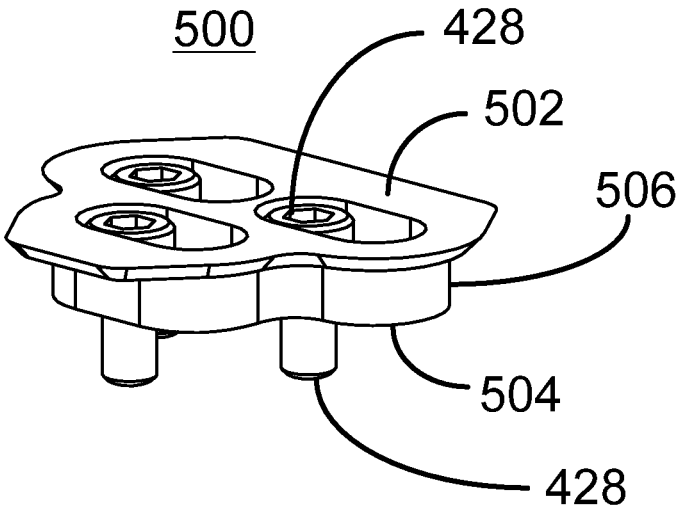

FIGS. 5A and 5B illustratively show a mounting plate consistent with certain embodiments of the present invention. In certain embodiments, the front mounting plate 208 and the rear mounting plate 206 are essentially identical, herein generically designated as element 500. Other embodiments contemplate the front and rear mounting plates 208 and 206 as having different shapes, but fundamentally both function to attach the cups 202 and 204 to the boot sole 216. With continued reference to the mounting plate 500, shown therein are three bolts 413 that are used to removably attach the cup 202 or 204 to the mounting plate 500. Other means for removably attaching the cups 202 and 204 to the mounting plates 500 include quick releases, mating structures that removably interlock, just to name a few examples. Certain embodiments contemplate the mounting plates 500 integrated in (built in) the boot sole 216. For example, the mounting plates 500 are formed in the rigid boot sole 216 such that the mounting plate top 502 is essentially flush with the top portion of the boot sole 216 that is in contact with a hockey player's foot or a sole insert (not shown) that is used as a cushion between the hard top portion and the hockey player's foot. Certain embodiments contemplate the mounting plate thickness 506 to be essentially the thickness of the boot sole 216. In one embodiment, the boot sole 216 is constructed out of a hard plastic that is molded around by the boot sole 216 to fixedly retain the mounting plate 500 in the boot sole 216 exposing only the mounting plate top 502 and the mounting plate bottom 504, wherein the mounting plate bottom 504 provides a surface that is adapted to be in contact with the top 410 or 412 of a cup 202 or 204, respectively. Another optional embodiment contemplates the boot sole 216 being constructed from carbon fiber that is molded around to fixedly retain the mounting plate 500 exposing only the mounting plate top 502 and the mounting plate bottom 504. In yet another optional embodiment, the mounting plate top 502 is slightly buried under the inside surface of the boot sole 216, such that slotted shapes are machined out from the inside surface of the boot sole 216 to expose the slotted openings 510. One embodiment contemplates the mounting plate 500 being textured to be better secured to the boot sole 216 when molded therein. The mounting plates 500 can be made of metal, such as aluminum, steel, titanium, etc., or can be a composite carbon material or polymer, for example, or ceramic. Yet other embodiments contemplate the mounting plates 500 constructed from a laminate of different materials sandwiched together that run parallel to the surface that mates with the ice hockey skate boot sole 216.

Figure 1:
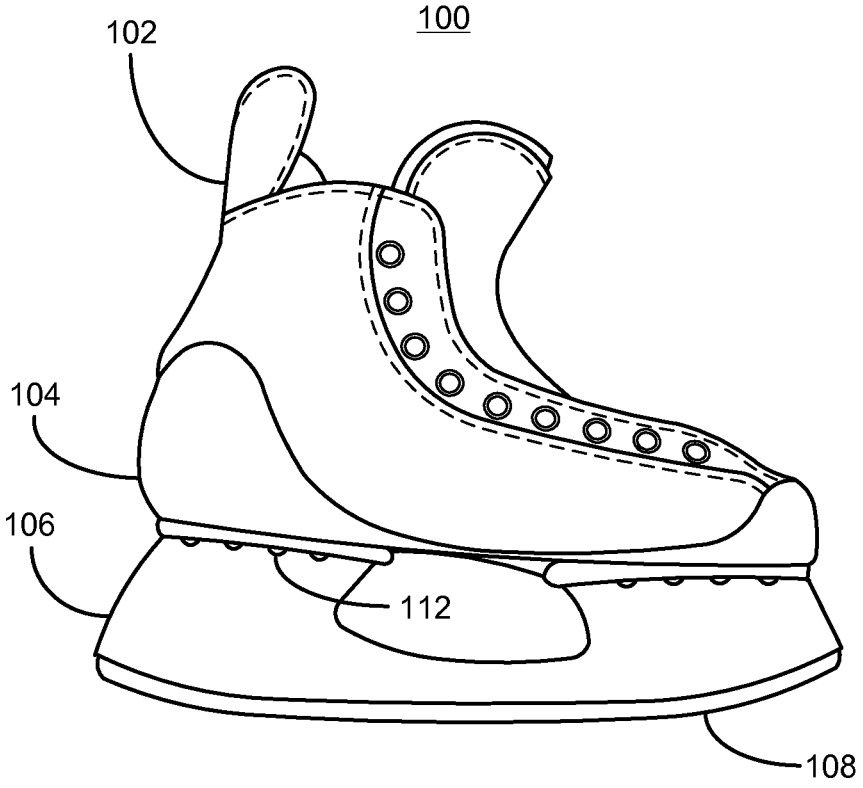
PRIOR ART FIG. 1
FIG. 1 is an illustration of a prior art ice hockey skate.

In an optional embodiment, shown in FIGS. 5B1 and 5B2, the mounting plate 500 provides slotted openings 510 that accommodate the bolts 413 and allow for offset adjustment of the cups 202 and 204 and runner-blade assembly 220. More specifically, as illustratively shown in FIG. 5B1, the bolts 413 fixedly screw into accommodating holes 414 in the back cup 204 essentially retaining the cup 204 in an offset position to the far left to create an offset of the runner-blade assembly 220. The back cup 204 is used herein to simplify the explanation; however the same optional adjustments can be done with the front cup 202. FIG. 5B2 shows the inverse of FIG. 5B1 whereby the bolts 413 are positioned in the far right of the slots 510, thus creating an offset with the runner-blade assembly 220 in the other direction. Optionally, the bolts 413 are positioned in the slots 510 of the front mounting plate 500 to the far left and the bolts 413 are positioned in the slots 510 of the rear mounting plate 500 to the far left, thus positioning the runner-blade assembly 220 offset to one side of the boot sole 216, but without an angular offset. Optionally, the bolts 413 are positioned in the center of the slots 510 in the front and back mounting plates 500 for a neutral positioning of the runner-blade assembly 220. Optionally, the bolts 413 are positioned in the slots 510 such that the positioning of the runner-blade assembly 220 offset has an angular offset (e.g., the bolts 413 are to the left side of the slots 510 in the rear mounting plate 500 and to the right side of the slots 510 in the front mounting plate 500). Other embodiments contemplate the tops 410 and 412 of the cups 202 and 204, respectively, and/or the mounting plates 500 providing detents to position the offset in a standard manner, for example −3 (corresponding to the far left), −2, −1, 0 (corresponding to neutral), +1, +2, +3 (corresponding to the far right). In this way, a hockey player that knows their personal setting is a +1 (a little in offset to the right), for example, can simply move the mounting plate to +1 and tighten the bolts 413.

Figure 5C:
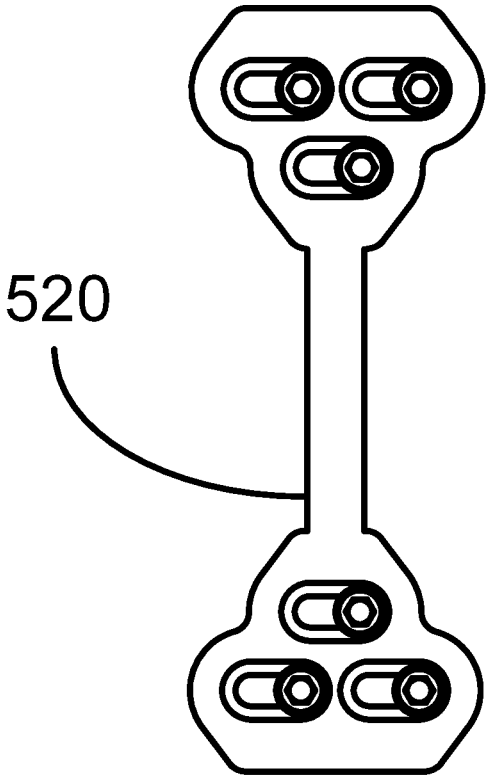

Certain embodiments contemplate the front mounting plate 208 and the back mounting plate 206 being joined together to form a one piece unit 520, as illustratively shown in FIG. 5C. A one piece unit 520 can improve the stiffness of the boot sole 216 and the manufacturability of integrating the mounting plates within or on the sole. Another embodiment contemplates a boot sole and the mounting plates being one and the same unit. For example, the one sole unit being a size-9, yet another being a size-12 unit that is integrated (sown in, glued in) the boot 218.

The slots 510 can accommodate a method for customizing the position of the runner-blade assembly 220 relative to the boot sole 216. One embodiment contemplates loosening the bolts 413, such as with an allen-key if it is an allen-head bolt, in the rear mounting plate 206 and in the front mounting plate 208. This is accomplished by accessing the inside surface of the boot sole 216 by reaching inside the hockey skate boot 218; sliding the front cup 202 to a non-neutral position, such that the bolts 413 slide to one side of the slots 510 in the front mounting plate 208; sliding the back cup 204 to a non-neutral position, such that the bolts 413 slide to one side of the slots 510 in the rear mounting plate 206, wherein the neutral position is when the bolts 413 are in the center of the slots 510; tightening the bolts 413 to essentially lock the cups 202 and 204 to the mounting plates 206 and 208 in an immobile arrangement to secure the offset positioning. The offset positioning can be optimized for a specific hockey skater.

Certain embodiments contemplate a compliant gasket between the bottom surface 504 of the mounting plates 208 and 206 and the mating surface 410 and 412 of the cups 202 and 204, respectively, such as a rubber gasket, a low elastic modulus metal gasket, a fabric gasket, etc. Such a surface adds friction to reduce the chance of any movement between the cups 202 and 204 and the mounting plates 208 and 206. Yet other embodiments contemplate a compliant overcoat on the surfaces of the mounting plates 206 and 208 that mate with (are in contact with) the ice hockey skate boot sole 216, such as a thin rubber or polymer paint, for example. Yet other embodiments contemplate an interlocking structure on the bottom surface 504 of the mounting plates 208 and 206 and the mating surface 410 and 412 of the cups 202 and 204, respectively. Such interlocking structures can be grooves, waffle shapes, pins and accommodating holes, etc.

Figure 6:
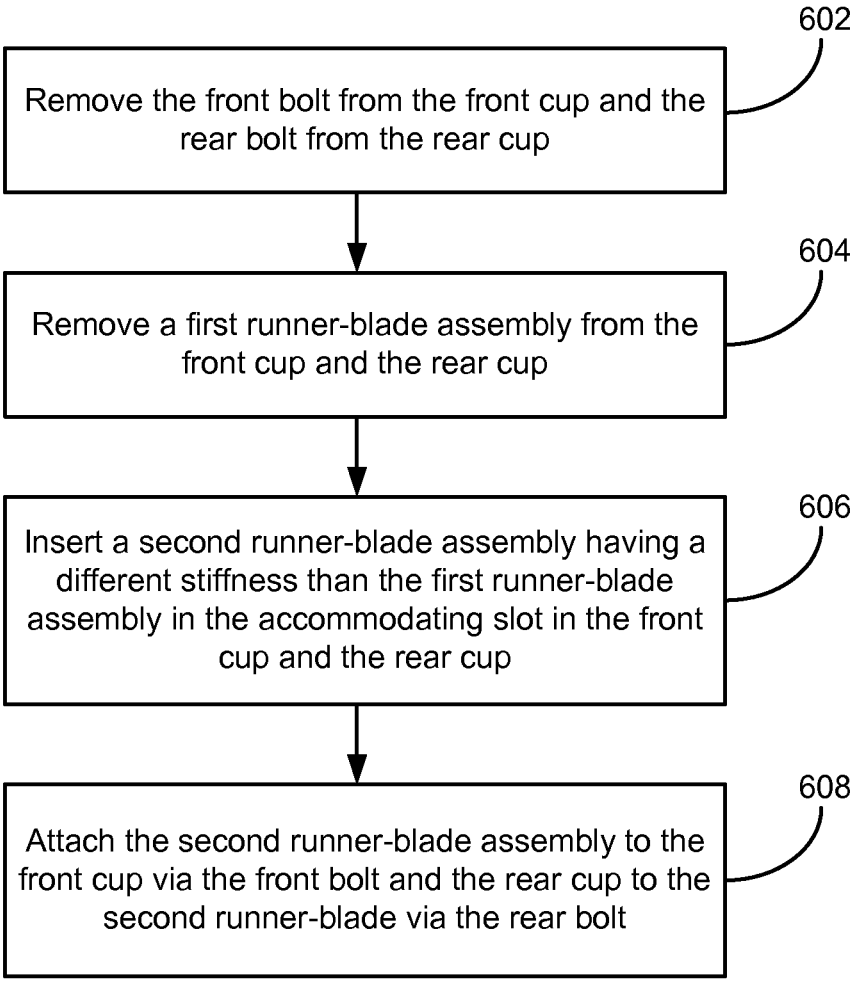
FIG. 6 is a block diagram of a method to swap out runner-blade assemblies in accordance with certain embodiments of the present invention.

FIG. 6 illustrates an embodiment of a method for exchanging (swapping out) a first runner-blade assembly that has a first stiffness with a second runner-blade assembly with a second stiffness that is different from the first stiffness. FIG. 6 is described in conjunction with FIGS. 2B and 4F. It should be recognized that the steps presented in the described embodiments of the present invention do not necessarily require any particular sequence unless otherwise stated. When the runner-blade assembly 220 needs to be replaced with a different runner-blade assembly because of damage, wear to the blade surface 310, or to change the stiffness of the runner-blade assembly the following steps are carried out. With reference to step 602, the front bolt 212 is loosened and removed from the front cup 202 and the rear bolt 214 is loosened and removed from the back cup 204. As illustratively shown in step 604, once the bolts 212 and 214 are removed, the first runner-blade assembly 220 is pulled-out from the corresponding runner-blade assembly slots 430 in the bottom of the cups 202 and 204. A second runner-blade assembly is then inserted, via the second runner-blade assembly tongues 336, in the corresponding runner-blade assembly slots 430 in the bottom of the cups 202 and 204, step 606. Once the holes 302 and 304 are aligned, the front bolt 212 is inserted and tightened in place and the rear bolt 214 is inserted and tightened in place. Certain embodiments contemplate a mating structure in the tongue 336 and corresponding runner-blade assembly slot 430 to align the holes 304 between the cups 202 and 204 and the runner-blade assembly 220, such as a key and key-hole, or another tongue and groove system that extends from the opening of the slot 432 to the back of the slot 434. A stiffer runner-blade assembly may be used for a heavier, more aggressive, or less tired hockey player, for example.

It is to be understood that even though numerous characteristics and advantages of various embodiments of the present invention have been set forth in the foregoing description, together with the details of the structure and function of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. For example, the shape of the runner 210 and ice skate blade 211 may differ from the depicted embodiments to alter certain directional stiffness, for example, while still maintaining substantially the same functionality without departing from the scope and spirit of the present invention. Another example can include alternate assemblies to construct the cups 202 and 204, such as a molded or machined cup without a top 410 or 412 whereby the top 410 or 412 are attached later to form the complete cup 202 and 204, or optionally no top exists, just receiving holes 414 for the bolts 413, to name a few examples while still maintaining substantially the same functionality without departing from the scope and spirit of the present invention. Further, for purposes of illustration, a first and second runner-blade assembly is used herein to simplify the description for a plurality of optional runner-blade assemblies. Additionally, as touched upon in conjunction with FIGS. 2A and 2B, multiple styles of hockey skate boots, such as a goalie's boot or a defense player's boot, can operatively be employed while maintaining substantially the same functionality without departing from the scope and spirit of the present invention. Another example can include alternate runner-blade assemblies that are shorter, longer, higher, etc., with the ability to interchangeably couple to the cups 102 and 104 to name a few examples while still maintaining substantially the same functionality without departing from the scope and spirit of the present invention. Finally, although the preferred embodiments described herein are directed to standard ice hockey skate and related technology, it will be appreciated by those skilled in the art that the teachings of the present invention can be applied to alternate types of ice hockey skates, without departing from the spirit and scope of the present invention.

It will be clear that the present invention is well adapted to attain the ends and advantages mentioned as well as those inherent therein. While presently preferred embodiments have been described for purposes of this disclosure, numerous changes may be made which readily suggest themselves to those skilled in the art and which are encompassed in the spirit of the invention disclosed and as ultimately defined in the claims.

What is claimed is:

1. A hockey skate, comprising:

a boot including a sole;

a first cup attached to the sole, the first cup comprising a first material having first vibration-damping properties;

a second cup attached to the sole, the second cup comprising a second material different than the first material, the second material having second vibration-damping properties different than the first vibration-damping properties; and a runner-blade assembly removably attached to the first and second cups.

2. The hockey skate of claim 1 wherein the runner-blade assembly comprises a runner integrated with a skate blade.

3. The hockey skate of claim 2 wherein the first cup and the second cup have different vibration-damping properties than the runner.

4. The hockey skate of claim 1 wherein at least one of the first and second cups is removably attached to the sole.

5. The hockey skate of claim 4 wherein the first cup and the second cup are separately removable from the sole such that the first cup may be replaced with a third cup without removal of the second cup.

6. The hockey skate of claim 1 wherein at least one of the first and second cups is removably attachable at multiple lateral locations on the sole.

7. The hockey skate of claim 1 wherein the runner-blade assembly has a first stiffness, and wherein the first and second cups are configured to receive runner-blade assemblies having a different stiffness than the first stiffness.

8. The hockey skate of claim 1 further comprising a first mounting plate—to which the first cup is mounted—fixed to a first end of the boot, and a second mounting plate—to which the second cup is mounted—fixed to a second end of the boot.

9. The hockey skate of claim 8 wherein the first and second mounting plates each comprise a layer of damping material.

10. The hockey skate of claim 8 wherein the first and second mounting plates are made of different materials than the first and second cups.

11. The hockey skate of claim 1 wherein the runner-blade assembly comprises a runner removably attached to a skate blade such that the skate blade is attachable to runners having different stiffness properties.

12. The method of claim 1 further comprising replacing the first cup with a third cup having different vibration-damping properties than the first cup.

13. A hockey skate, comprising:

a boot including a sole;

a first cup removably attached to the sole, the first cup comprising a first material having first vibration-damping properties;

a second cup removably attached to the sole, the second cup comprising a second material different than the first material, the second material having second vibration-damping properties different than the first vibration-damping properties; and a runner-blade assembly attached to the first and second cups.

14. The hockey skate of claim 13 wherein the runner-blade assembly is removably attached to the first and second cups, and the first cup and the second cup are separately removable from the sole such that the first cup may be replaced with a third cup without removal of the second cup.

15. The hockey skate of claim 13 wherein at least one of the first and second cups is removably attachable at multiple lateral locations on the sole.

16. The hockey skate of claim 13 further comprising a first mounting plate—to which the first cup is mounted—fixed to a first end of the boot, and a second mounting plate—to which the second cup is mounted—fixed to a second end of the boot, wherein the first and second mounting plates are made of a different material than the first and second cups such that they provide damping interfaces between the first and second cups and the sole.

17. A method of changing the vibration-damping properties of a skate that includes a first runner-blade assembly attached to a first cup and a second cup, with the first and second cups attached to a sole of the skate, comprising:

detaching the first runner-blade assembly from the first and second cups; and attaching a second runner-blade assembly to the first and second cups, the second runner-blade assembly having the same physical configuration as the first runner-blade assembly but having different vibration-damping properties than the first runner-blade assembly.

18. The method of claim 17 further comprising replacing the blade of the runner-blade assembly with a different blade having different vibration-damping properties.

* * * * *